US005621184A

United States Patent [19]

Gwynn, III

[11] Patent Number: 5,621,184

[45] Date of Patent: Apr. 15, 1997

[54] PROGRAMMABLE ELECTRONIC TIMER CIRCUIT

[75] Inventor: James C. Gwynn, III, Lititz, Pa.

[73] Assignee: The Ensign-Bickford Company, Simsbury, Conn.

[21] Appl. No.: 420,991

[22] Filed: Apr. 10, 1995

[51] Int. Cl.[6] ..... F42C 21/00; F42D 1/00

[52] U.S. Cl. ..... 102/215; 102/206

[58] Field of Search ..... 102/215, 206, 102/200

[56] References Cited

U.S. PATENT DOCUMENTS

| | | | |
|---|---|---|---|
| 3,533,088 | 10/1970 | Rapp . | |
| 3,851,589 | 12/1974 | Meyer | 102/215 |
| 3,955,069 | 5/1976 | Ziemba . | |
| 4,222,226 | 9/1980 | Miyatake et al. . | |
| 4,445,435 | 5/1984 | Oswald | 102/215 |
| 4,563,828 | 1/1986 | Kriegeskorte . | |
| 4,712,477 | 12/1987 | Aikou et al. | 102/206 |
| 4,825,765 | 5/1989 | Ochi et al. | 102/206 |
| 4,869,171 | 9/1989 | Abouav | 102/215 |
| 4,897,860 | 1/1990 | Lee et al. . | |
| 4,960,033 | 10/1990 | Qquantz . | |
| 5,042,386 | 8/1991 | Kruse et al. . | |
| 5,151,611 | 9/1992 | Rippey . | |
| 5,153,458 | 10/1992 | Hinooka . | |
| 5,173,569 | 12/1992 | Pallanck et al. . | |
| 5,363,765 | 11/1994 | Aikou et al. | 102/215 |
| 5,460,093 | 10/1995 | Prinz et al. | 102/215 |

*Primary Examiner*—Michael J. Carone
*Assistant Examiner*—Theresa M. Wesson
*Attorney, Agent, or Firm*—Victor E. Libert; Frederick A. Spaeth

[57] ABSTRACT

A programmable timer circuit (18) includes a counter (22) that contains a plurality of sequentially arranged counter stages (**22*a*, 22*b*). A toggle logic gate (25**) is disposed between each sequential pair of counter stages to accept the output signal from the preceding stage and to issue an input signal to the succeeding counter stage. The logic state of the input signal is determined by the logic state of the preceding output signal and the logic state of a program stage signal from an associated program stage. The logic state of the program signal is determined by the state of a fuse (F) associated with the program stage. Selected fuses can be blown by a programming routine to adjust the time delay between the initiation signal and issuance of the output signal. This sets the counter stages at power-up to a predetermined logic state in which the output signal will be produced with a predetermined time delay when the initiation signal is applied to the integrated circuit. The program routine includes activating the counter stages that will be active at the desired count and issuing a programming signal to burn the fuse associated with the active counter stage.

9 Claims, 8 Drawing Sheets

PROGRAMMABLE ELECTRONIC TIMER CIRCUIT

BACKGROUND OF THE INVENTION

1. Field of the Invention

The present invention relates to an electronic timer circuit and in particular to a new and useful programmable electronic timer circuit. The timer circuit is designed to provide stable, accurate and repeatable time delays between an input signal it receives and an output signal it produces over a wide range of operating voltages and temperatures. The invention also relates to an electronic detonator circuit that includes such a timer circuit to provide an output signal to initiate an explosive charge after a predetermined time interval from receipt of an initiation signal.

2. Related Art

In a detonator for initiating an explosive charge it is often important to precisely control the timing with which the explosive charge is initiated after receipt of an initiation signal. It is known to provide a detonator with a pyrotechnic or an electronic timer for this purpose. For example, in controlling the timing of a sequence of explosions in blasting operations such as mining, quarrying, construction or demolishing a structure, such as a building, a series of explosive charges must be set off in a precisely timed sequence, in order to obtain the desired blasting effect, minimize shock forces acting on the surrounding area and properly demolish the structure. This requires a series of detonators, each of which can initiate an explosive charge at a predetermined precise time interval, usually measured in milliseconds, from receipt of an ignition signal.

Conventional pyrotechnic delay elements incorporated into detonators used to initiate explosive charges are subject to inherent manufacturing variations with respect to density and type of chemical delay composition contained therein, and so cannot be relied upon to provide highly accurate delay intervals.

It is known in the art that electronic time delay circuits can be used in place of pyrotechnic delay elements. For example, the inclusion within a conventional-sized detonator cap of electronic timing circuitry in lieu of the usual pyrotechnic delay train to provide a delay between receipt by the cap of an initiation signal and detonation of the cap, is illustrated in U.S. Pat. No. 5,173,569 of Robert G. Pallanck et al, issued Dec. 22, 1992, for "Digital Delay Detonator". This patent shows a detonator cap that incorporates electronic circuitry which is responsive to an input signal to the cap to establish a delay between receipt of the input signal and detonation of a small explosive charge within the cap. The cap is mounted on the end of a length of shock tube which carries an impulse type initiation signal to the cap. The impulse signal acts on a piezoelectric generator forming part of the circuitry, and the piezoelectric generator generates an electric input signal to the electronic timer circuit. After a predetermined delay the timer circuit emits an output signal that is used to fire the cap.

Conventional electronically-timed detonators suffer from limitations inherent in conventional electronic timers with respect to the flexibility and reliability with which they may be programmed (to provide a desired delay interval) and tested. For example, conventional multi-stage digital timers may consist of a number of toggle-counter stages, each with a separate line that is brought out of the circuit for programming purposes. Each of those lines has to be mechanically connected to either the supply voltage or ground signal and another program line is required to load these program signals into the counter stages. The counter stages are pre-set to the voltage levels that their individual program lines are connected to when the program line is activated. Such timers do not contain built-in voltage regulators and do not contain built-in oscillator circuits. A conventional fourteen-stage programmable counter would require two power supply lines, fourteen programming lines, one program load line, one oscillator input line and at least one output line. Such a circuit would require at least nineteen separate lines for proper operation.

SUMMARY OF THE INVENTION

In accordance with the present invention there is provided a programmable timer circuit which is designed to receive an electric initiation signal and to produce a timer output signal at a predetermined time interval from receipt of the electric initiation signal. The timer circuit comprises an electrically powered counter comprising a plurality of sequential counter stages including a first counter stage and a last counter stage for issuing a timer output signal. Each counter stage is configured to receive a counter stage input signal having one of an active and an inactive logic state and to issue a counter stage output signal having one of an active and an inactive logic state. The logic state of a counter stage output signal is responsive to a change in the logic state of the counter stage input signal. There is an electrically powered oscillator for providing a counter stage input signal to the first counter stage. The circuit also comprises an electrically powered programming circuit comprising (i) a toggle logic gate between each counter stage and the next sequential counter stage for receiving from the preceding counter stage the counter stage output signal and for receiving a program stage signal having one of an active and an inactive logic state. The toggle logic gate issues to the succeeding counter stage a counter stage input signal having a logic state determined by the logic states of the program stage signal and the counter stage output signal. The programming circuit also includes a program stage associated with each toggle logic gate. Each program stage is configured to issue to the associated toggle logic gate the program stage signal. The timer circuit further comprises electronic initializing means for placing the timer circuit in a logic state determined by the programming circuit prior to incrementing the counter, and power supply means for providing operating power to at least the counter, the oscillator, the programming circuit and the initializing means.

According to one aspect of the present invention, the programming circuit may comprise a fuse current input, and each program stage may comprise: (a) a latch means for producing a latch signal from which the program stage signal is derived, (b) a fuse which when intact during operation of the timer grounds the latch signal whereby the program stage signal has an inactive logic state and which when blown allows the latch signal to yield a program stage signal having an active logic state, and (c) a fuse switch means responsive to the logic state of the preceding counter stage output signal, for passing the fuse current to the fuse to blow the fuse when the preceding counter stage output is active.

According to another aspect of the invention, the timer circuit may further comprise a program signal input for receiving and conveying to each program stage a program signal, and each fuse switch means may be responsive to the presence of a program signal whereby the fuse switch means will pass the fuse current to the fuse when the preceding counter stage output signal has an active logic state.

According to still another aspect of the invention, the programming circuit may further comprise test means associated with each program stage for yielding an active program stage signal even when the fuse is intact.

The timer circuit of the invention may be incorporated in an electronic delay detonator circuit for use in blasting initiation systems energized by a non-electric impulse signal. Such a detonator circuit may comprise (i) a signal conversion means for receiving an impulse signal from an impulse signal transmission line and converting the impulse signal to an electric initiation signal; (ii) an electronic timer circuit as described above for counting a selected time interval in response to receiving the electric initiation signal; the electronic timer circuit being connected to the signal conversion means to receive therefrom the electric initiation signal and thereupon to start counting a selected time interval and, upon lapse of the time interval, to issue an output signal; and (iii) an electrically operable igniter means connected to the electronic timer circuit for energizing a detonator output charge upon receipt of a timer output signal from the timer circuit.

The detonator circuit may comprise part of an electronic delay detonator comprising a housing having one end dimensioned and configured to be coupled to a signal transmission line capable of transmitting a non-electric impulse input signal into the housing, an electronic delay detonator circuit as described above with the signal conversion means disposed in signal communication relationship to the signal transmission line, and a detonator output charge in initiation relation to the igniter means.

DETAILED DESCRIPTION OF THE INVENTION AND PREFERRED EMBODIMENTS THEREOF

The timer circuit of the present invention can be permanently programmed to interpose a preselected delay between the receipt of an initiation signal and the emission of an output signal.

A timer circuit according to the present invention does not lose its program with power loss. Moreover, it will function properly after significant periods of non-use and can function over a wide range of operating voltages and temperatures. The timer circuit of the present invention requires fewer external connection lines for its operation than conventional programmable timer circuits, has a standard unprogrammed circuit configuration and is one-time programmable to provide an output signal after a predetermined time interval from the application of the input signal. If desired, a timer circuit according to the present invention is capable of being factory-programmed to provide an electronically-controlled time delay and to obviate the need for field-programming the selected delay. Alternatively, the timer circuit can be incorporated into devices configured for programming by the end-user to permit selection of a desired delay interval in the field.

The timer circuit of the present invention is generally useful in any circumstances in which an electronically timed delay is required. For example, a timer circuit in accordance with the present invention can be incorporated into an electronic detonator circuit to provide an electronic firing signal after a predetermined interval following the receipt of an electronic initiation signal. Thus, a series of detonator circuits constructed according to the present invention can be individually programmed with different selected time delays, to provide output signals that initiate a series of explosive charges in a precisely timed sequence.

The following detailed description relates to a detonator circuit with an embodiment of the electronic timer of the present invention incorporated therein in a manner generally known to those of ordinary skill in the art, and as described, for example, in U.S. Pat. No. 5,173,569, which is discussed above and the disclosure of which is hereby incorporated herein.

Figure 1:
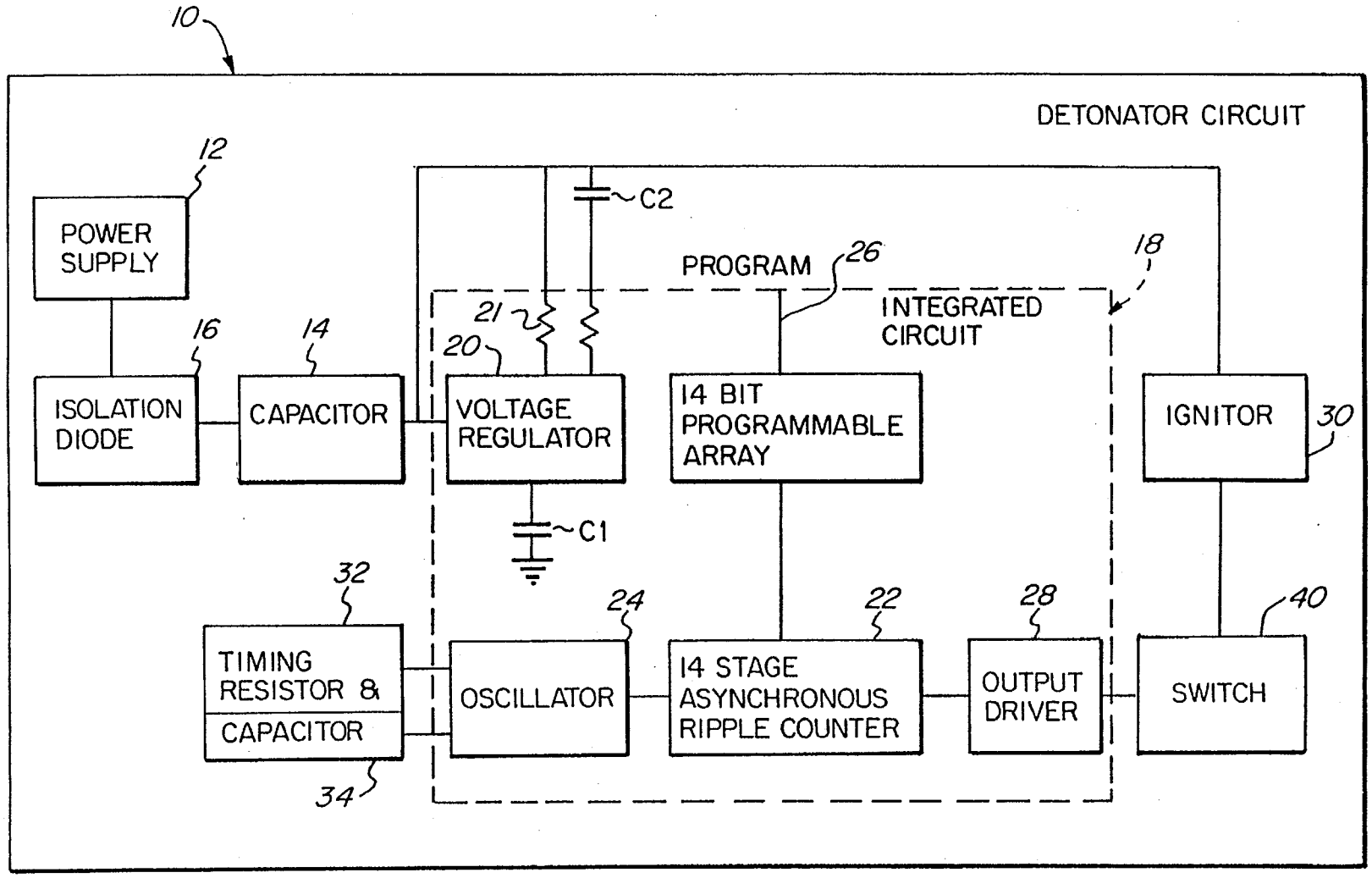
FIG. 1 is a schematic block diagram of the components of a detonator circuit comprising a timer circuit in accordance with the present invention.

As shown in FIG. 1, detonator circuit 10 includes a power supply 12 which is capable of providing a short, high amplitude current pulse to charge a power supply capacitor (or "firing capacitor") 14. One suitable type of power supply is a piezotransducer capable of converting a shock tube signal into an electrical initiation pulse, as described more fully below. The power supply capacitor 14 is isolated from the power supply 12 by an ultra-fast recovery rectifier or isolation diode 16. The charged power supply capacitor 14 produces an input voltage VCC which is then used to power the rest of the detonator circuit, including the timer circuit.

Power supply capacitor 14 is in circuit communication with an integrated circuit 18 which comprises a programmable electronic timer circuit according to one embodiment of the present invention. The integrated circuit 18 includes a voltage regulator 20, a 14-stage asynchronous ripple counter 22, an oscillator 24, a 14-bit programmable array 23 and an output driver 28. The integrated circuit includes a single programming input line 26 for programming the integrated circuit 18 to a predetermined logic state. Counter 22 interposes a time delay between the receipt by integrated circuit 18 of an electronic initiation signal and the issuance of a timer output signal to optional output driver 28. The delay is determined by the frequency of the oscillator and the programming state of the circuit. The timer output signal activates output driver 28 which then issues a firing signal. The firing signal operates an electronic switch 40 such as a Darlington switch to close a branch circuit through which power supply capacitor 14 discharges through igniter 30 to fire the detonator, as discussed more fully below.

The voltage regulator 20 regulates the output of power supply capacitor 14 voltage down to a very stable voltage in the 2 to 5 volt range, e.g., 3 volts, which is used by the remainder of the integrated circuit 18 and which is designated VDD. The voltage regulator 20 requires two external capacitors C1 and C2 to operate, i.e., capacitors that are not manufactured as part of the integrated circuit but which are connected thereto. Capacitor C1 is charged to voltage VDD by voltage regulator 20 and is used as a storage device to reduce the ripple on the regulated voltage and to provide power to the remainder of the integrated circuit. The second external capacitor C2 is used to bypass the current-limiting resistor 21 to allow the voltage regulator 20 to come up to operating voltage very quickly each time power is re-applied to the circuit.

The oscillator 24 provides a stable periodic rising and falling signal to the counter 22. The period of the signal is a significant factor in determining the timing range in which the circuit can be programmed to a selected time delay. Optionally, oscillator 24 may be an oscillator whose frequency is determined by an external timing resistor 32 and timing capacitor 34. By choosing such an oscillator, the same integrated circuit can easily be modified to vary its maximum time interval by appropriate choice of external components. However, a fixed frequency oscillator may be employed, if desired.

Preferably, the oscillator 24 is configured to remain stable over an operational temperature range of −55° C. to 65° C. so that it will operate in typical outdoor applications despite variations in weather or climate. This is achieved by providing a thermally stable reference voltage. The voltage regulator 20 is based on a bandgap reference which in itself is extremely temperature-stable. In addition, the timer circuit comprises a standard oscillator circuit designed to operate on a current that is small enough to be insensitive to small changes in circuit performance and high enough that the oscillator maintains its bi-stable operation. The oscillator circuit comprises three polysilicon resistors which act as a voltage divider to provide two threshold voltages for various branches of the oscillator circuit. Preferably, the resistors are chosen so that changes in these resistors over temperature offset the changes in the oscillator thresholds. The careful selection of the external resistor 32 and capacitor 34 also play a major role in the oscillator performance. Using a tight Temperature Coefficient Resistor and an NPO-type capacitor provides an oscillator that remains very stable over the operational temperature range of −55° C. to 65° C., e.g., it may have a thermal coefficient of less than 150 ppm/°C.

The counter 22 comprises two or more counter stages of toggle digital flip-flops that are disposed in a cascade or ripple arrangement with intervening programming circuitry, as will be described more fully below. The first counter stage is driven by the oscillator 24 and the output of the final counter stage is connected to output driver 28. Output driver 28 is activated when oscillator 24 causes counter 22 to increment to a logic state determined by the configuration of programmable array 23. As will be discussed in detail below, the configuration of programmable array 23 can be determined prior to use by providing appropriate programming signals via programming line 26.

Figure 2:
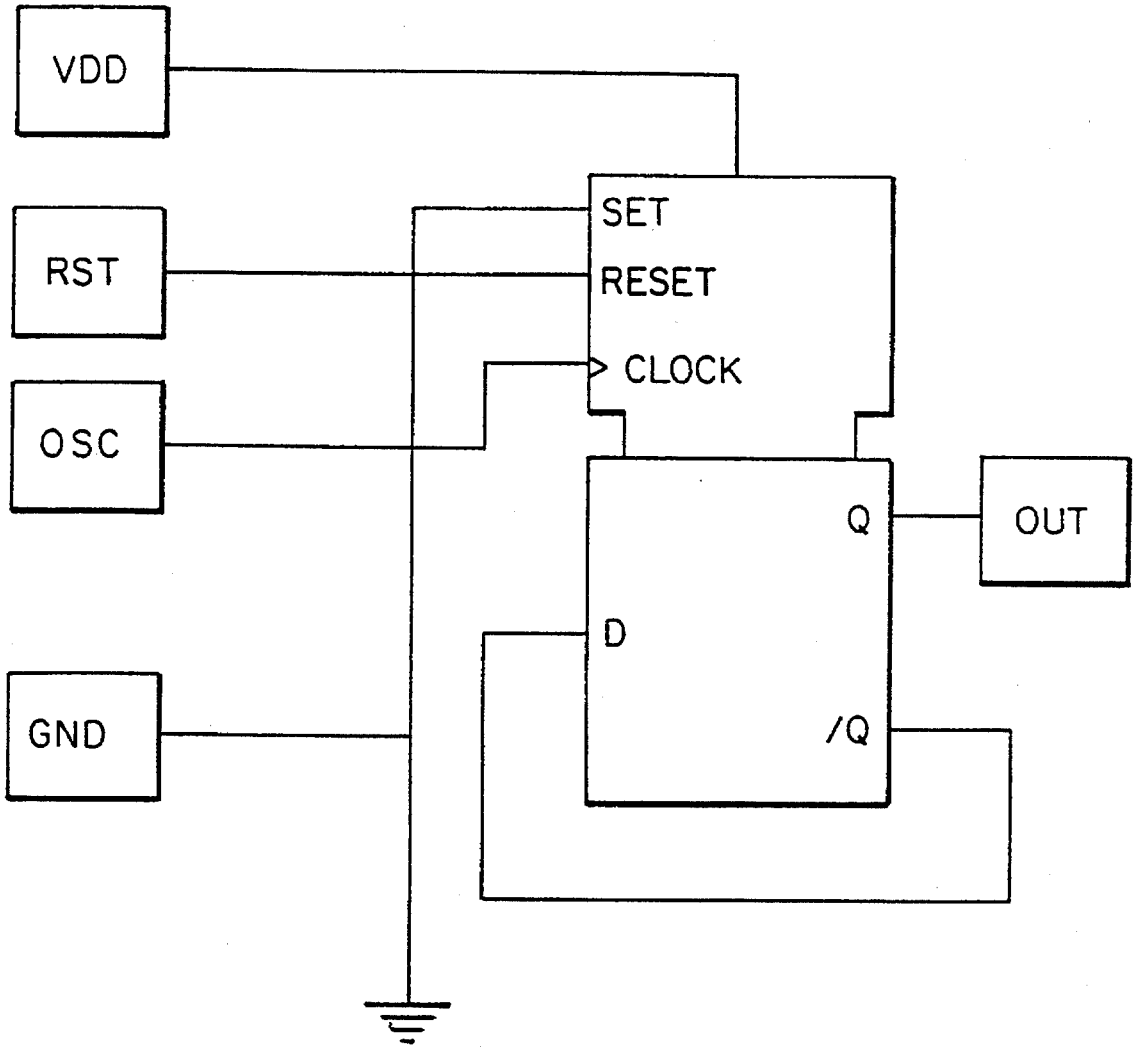
FIG. 2 is a schematic representation of a counter stage of the counter shown in FIG. 1.

FIG. 2 provides a conventional representation of a conventional flip-flop counter stage of the kind that may be used in counter 22 (FIG. 1). The flip-flop has a VDD port for receiving power from a power supply, e.g., from capacitor C1. It also has a clock port for receiving a counter stage input signal and a reset port and associated circuitry well known in the art for setting the logic state of the flip-flop output signal to a predetermined logic state (usually to an inactive state) upon receipt of a power-on-reset signal generated by power-on-reset circuitry (not shown) well-known in the art. The flip-flop also has an output port for issuing a counter stage output signal Q. There is also a second output port for issuing an inverse counter stage output signal /Q. Inverse output signal /Q is connected to an input port D to provide a conventional T-type flip-flop.

A conventional cascade-type counter comprises a series of flip-flop registers or "counter stages" whose output signals are all initially at the same inactive logic state (conventionally represented as "0") and which are connected so that the output Q of one counter stage is passed directly to the clock input of the next counter stage, i.e., the counter stages are arranged sequentially. The output Q of a counter stage does not change until the input changes from an active state (conventionally represented as "1") back to the original "0" inactive state. The switching of the logic state of the output of each successive counter stage from inactive to active, i.e., from "0" to "1", therefore represents an exponential division by two of the number of input pulses received at the first stage of the oscillator. For example, the output of the last counter stage of a conventional four-stage ("four bit") counter toggles from "0" to "1" after $2^3$ (i.e., 8) input pulses to the first counter stage, and it toggles back to "0" after $2^4$ (i.e., 16) input pulses to the first counter stage. The output of the last stage in any cascade counter represents the most significant bit of the counter, i.e., it represents a greater number of input pulses than any other counter stage. The significance of the counter stages decreases as their logical, i.e., sequential, proximity to the first counter stage increases.

Figure 3A:
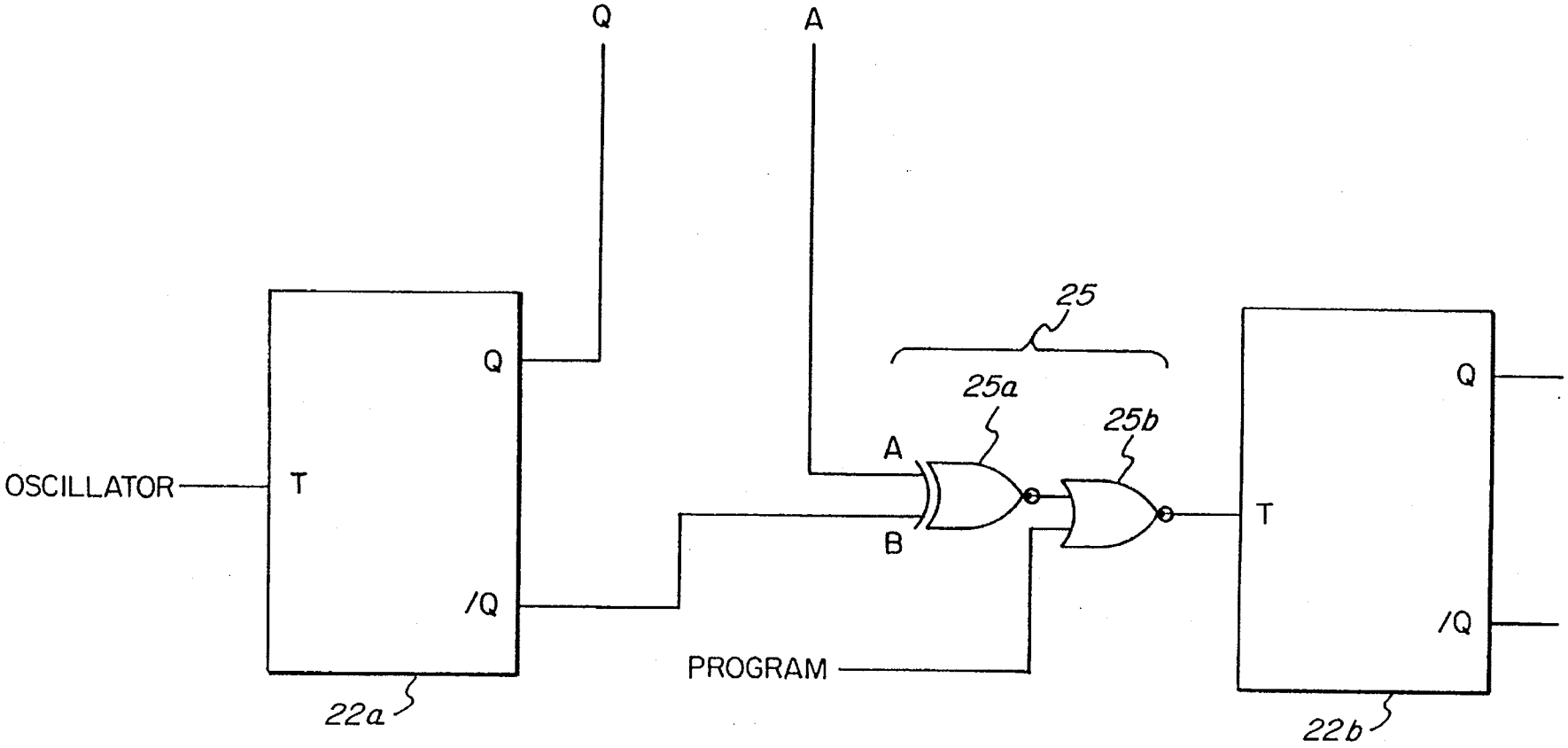
FIGS. 3A and 3B are schematic representations of a sequential pair of counter stages with an intervening toggle logic gate in accordance with the present invention.

A timer circuit in accordance with the present invention comprises programming circuitry that comprises an electronic toggle logic gate disposed between each successive pair of counter stages, i.e., between the first and second counter stages, between the second and third counter stages, etc., as toggle logic gate 25 is shown in FIG. 3A between counter stages 22*a* and 22*b*. The T input ports of counter stages 22*a* and 22*b* correspond to the clock port of the flip-flop of FIG. 2. Counter stages 22*a* and 22*b* also have reset, ground and VDD input ports like the flip-flop of FIG. 2, but to simplify the Figure, these are not shown. In the illustrated embodiment, the counter stage output signal /Q of counter stage 22*a* is passed to signal input B of toggle logic gate 25 which comprises gates 25*a* and 25*b* and which, during operation, also receives a program stage signal A from an associated program stage (not shown). Toggle logic gate 25 produces an input signal T for the succeeding counter stage 22*b*. The counter stage whose output is connected to a given program stage or toggle logic gate is referred to herein as the preceding counter stage with respect to that program stage and toggle logic gate; a counter stage that receives the output of the toggle logic gate as its input is referred to herein as the succeeding counter stage. Thus, with respect to toggle logic gate 25, counter stage 22*a* is the preceding counter stage and counter stage 22*b* is the succeeding counter stage. The counter stages are described as being sequentially arranged despite the intervening toggle logic gates.

During operation there is no program signal input provided to the logic gate, so the logic state of the program signal input to gate 25*b* assumes an "inactive" logic state. Accordingly, if signal A has an active logic state, toggle logic gate 25 issues to succeeding counter stage 22*b* an input signal having the opposite logic state from that of output signal /Q of the preceding counter stage, i.e., the toggle logic gate "inverts" signal /Q. On the other hand, if signal A has an inactive logic state, toggle logic gate 25 issues to counter stage 22*b* a signal having the same logic state as signal /Q, i.e., logic gate 25 passes the stage output signal /Q directly to the succeeding counter stage. Whether or not signal A has an active logic state during operation is determined by programming the timer circuit, as described below.

Figure 3B:
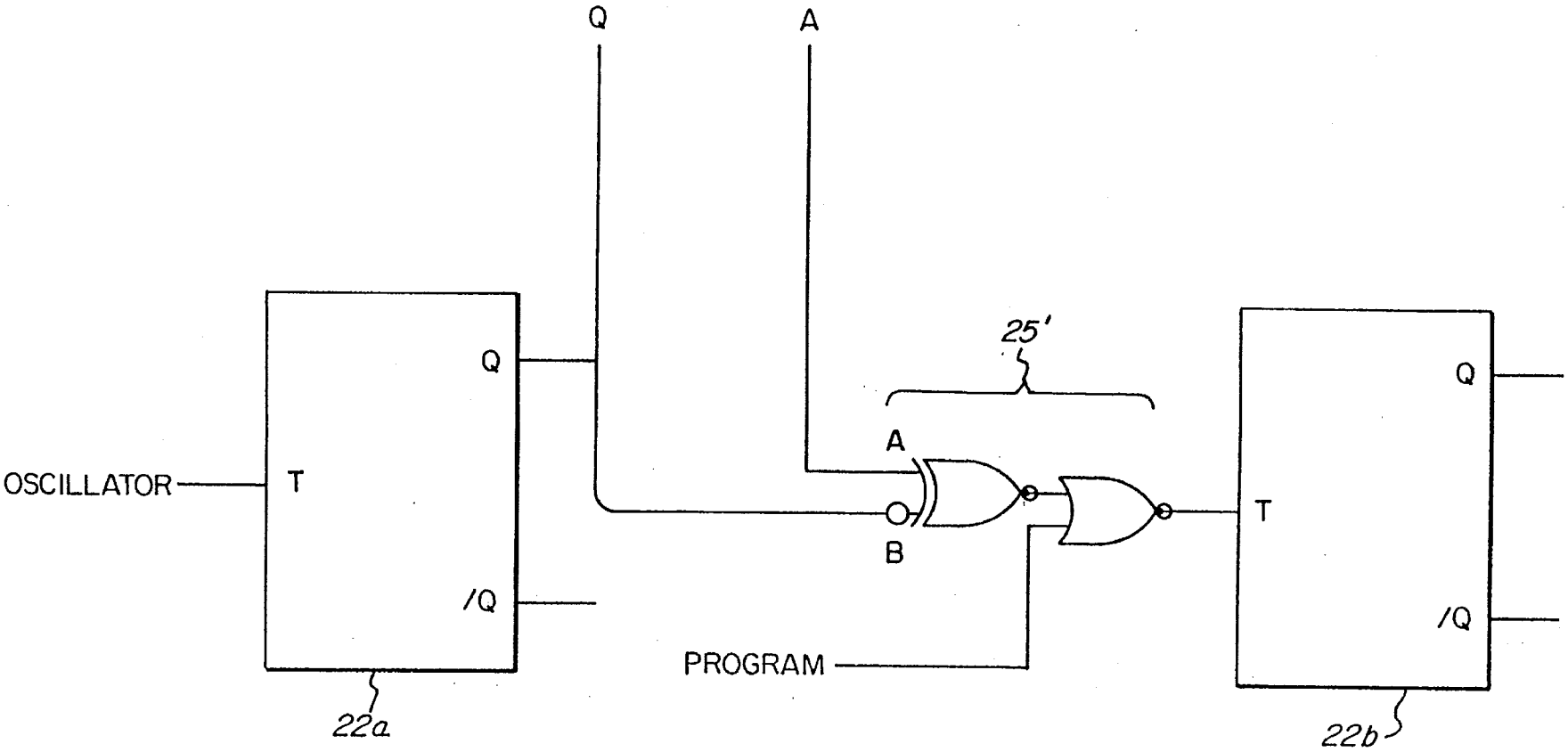

If signal A causes toggle logic gate 25 to invert signal /Q when the circuit is first powered up, counter stage output signal of counter stage 22*b* toggles sooner, i.e., after fewer oscillator pulses than it otherwise would, ultimately reducing the number of oscillator pulses that must occur before the counter issues an output signal to driver 28. Additional active A signals for other toggle logic gates will further reduce the pulse count required to issue a timer output signal in a manner that is comparable to binary subtraction. An equivalent, alternative toggle logic gate configuration is shown in FIG. 3B, in which the counter stage output signal Q of the preceding counter stage is passed to the toggle logic gate 25', as well as to the program stage (not shown).

Figure 4:
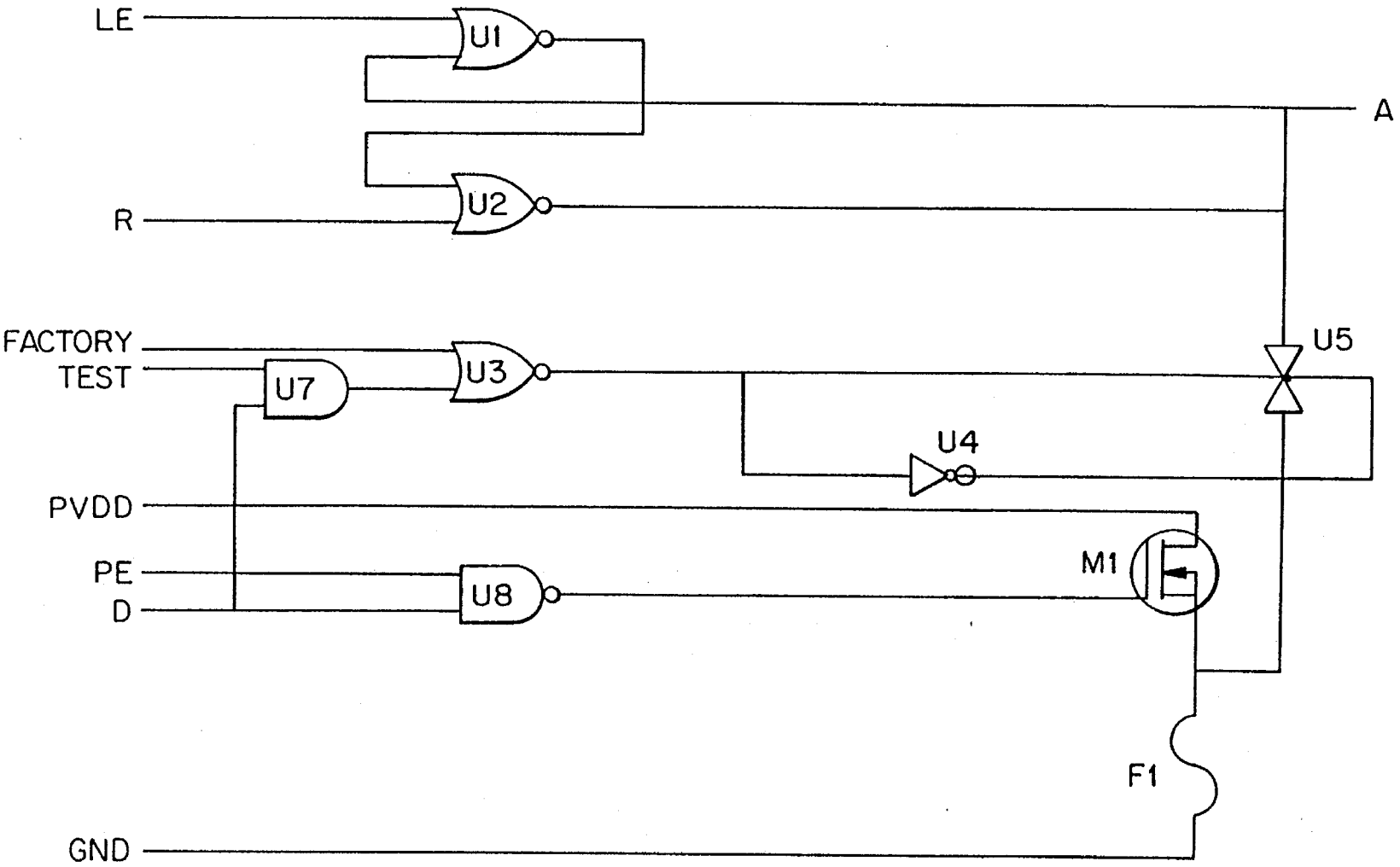
FIG. 4 is a logic diagram of a program stage, including test logic, as associated with each toggle logic gate according to one embodiment of the invention.

One embodiment of a program stage in accordance with the present invention is shown in FIG. 4. At start-up, the power-on-reset circuitry generates a reset signal pulse and a latch enable signal, which are received at inputs R and LE, respectively, by the latch comprising logic gates U1 and U2. The latch then produces a signal A. The state of the signal A will be determined by the state of fuse F, i.e., whether fuse F is intact or blown. If fuse F is blown, signal A will have an active logic state. If fuse F is intact, signal A will be pulled low to an inactive logic state.

If the timer circuit is initiated when all the fuses are intact, the power-on-reset condition of the input signal for each counter stage, i.e., the output of each toggle logic gate, has an inactive or "0" logic state which toggles to the active state represented as "1" only after the input to the preceding counter stage has toggled to "1" and then back to "0". Accordingly, in a sequence of n stages, the last counter stage will not toggle to "1" to activate output driver 28 until $2^{(n-1)}$ oscillator pulses have been received by the first counter stage. To reduce the number of oscillator pulses required to activate the output driver 28, appropriate fuses in the programming array must be blown by programming the timer circuit.

In the embodiment of FIG. 4, each programming stage contains a fuse switch M1 (which in the illustrated embodiment comprises a MOSFET n-channel, depletion-mode device) a fuse F1 connected to the source lead of fuse switch M1, and a program enable signal input PE and a counter stage input D connected to the inputs of a logic gate U8. The output of gate U8 is connected to the gate of fuse switch M1, and a program signal input PVDD is connected to the drain lead of fuse switch M1.

One way to program the circuit is to run the counter for the desired time interval and then stop it. The logic state of each counter stage output Q is sensed by the associated program stage as the input D. Then a fuse current signal PVDD of sufficient power to blow the fuses of all the program stages is supplied to programming input line 26 from an external test device. A logic level program enable command signal PE, derived from PVDD, is also provided to the program stage. If the logic state of the counter stage output is inactive, logic gate U8 will not activate switch M1 and the fuse current PVDD will not blow fuse F1. However, if the input D senses an output signal Q having an active logic state, logic gate U8 will activate switch M1 and fuse current PVDD will blow fuse F1. As indicated above, blowing the fuse will change the logic state of the program signal A. To prevent such a change from affecting the logic state of the succeeding counter stage during programming, a disabling program signal is provided to toggle logic gate 25 (FIG. 3A) during programming to prevent any change in the logic state of the input signal to the succeeding counter stage.

An alternative method which requires a less powerful PVDD program signal is to run the counter up to a count at which only the most significant counter stage bit has an active logic state. The program signal is applied to the programming line to blow the fuse of the program stage associated with the active counter stage. The circuit is then reset and run up to the next most significant bit and the program signal PVDD is re-applied. This cycle is repeated until all the fuses of program stages that receive active signals when the counter reaches the desired logic state have been blown.

When the circuit is Dowered down and later re-powered for use, the power-on-reset circuit provides a signal (R) and a signal (LE) to the latch of each program stage, which comprises logic gates U1 or U2 to produce an appropriate output signal A. If the fuse of the stage is blown, the A signal will have an active logic state. If the fuse is not blown, the A signal will have an inactive logic state. The A signal is passed to the associated toggle logic gate. Thus, at start-up, some of the toggle logic gates will have an active input signal A, others will not, and they will issue input signals to their respective succeeding counter stages accordingly. As described above, a reset signal is also sent to each counter stage at power-up to set the output signals to their inactive states. In this way the timing circuit is initialized at power-up, i.e., it is disposed in a predetermined logic state that will determine the number of oscillator pulses required to activate the output driver 28.

For manufacturing tests, the timer circuit comprises test logic gates (U3, U4 and U5) that can simulate the blown fuses prior to programming the circuit, i.e., prior to actually blowing the fuses. To test the circuit, the counter stages are set to the appropriate logic configuration, e.g., by running the counter to the desired count as described above for programming. Then, instead of providing program signal PVDD, test signals are provided to the input lines for gates U3 and U7. Gate U7 also senses the logic state of the associated counter stage output Q, which is designated input signal D. In the case of a test, if signal D is active, logic gates U3, U4, and U7 will operate to open U5, effectively disconnecting the latch gates U1 and U2 from the ground to simulate a blown fuse and to establish a test logic configuration. The test signals are maintained and the circuit is initialized so that the program stages issue output signals A in accordance with the test configuration. The timer circuit may then be initiated, and the interval between initiation signal and the issuance of an output signal can be measured.

After the timing circuit has been programmed, it is ready for use. Power supply 12 (FIG. 1) may then be stimulated to charge the power supply capacitor 14 to its operating voltage. The isolation diode 16 prevents the stored charge from dissipating back through the power supply 12. The by-pass capacitor C2 forces the storage capacitor C1 to come up to desired regulator voltage very quickly. Once the storage capacitor C1 is charged to the desired regulator voltage, the voltage regulator 20 takes over and begins to stabilize this voltage. The power-on-reset circuit activates the programming section latches to their programmed logic states and causes the counter stage output signals to issue inactive output signals, thus placing the timing circuit in the desired starting logic configuration. By this time the voltage regulator has stabilized and the oscillator 24 begins to cycle. At each rising edge of the oscillator 24 signal, the counter 22 increments in accordance with the logic configuration established by the programming circuit. After the oscillator has cycled to the appropriate count, the timer issues an output signal to output driver 28.

With the accuracy of the built-in oscillator, a stable, repeatable time delay for the issuance of a timer output signal is provided each time the circuit is powered up. In the illustrated embodiment, the timer output signal triggers an output driver 28 which activates a switch 40 to close a branch circuit through which firing capacitor 14 can fire igniter 30 to set off a detonator charge. A typical trigger device, or igniter means, may comprise a hotwire or a semiconductor bridge. An output driver suitable for this purpose is diagrammed in FIG. 5. It comprises two switches, one of which is activated by the timer output signal. When the output signal activates switch M2, switch M2 activates switch M3, which then applies voltage VDD from capacitor C1 to the trigger device which, in this case, is switch 40. The trigger device allows capacitor 14 to discharge through igniter 30, which energizes the output charge of the detonator.

Figure 6A:
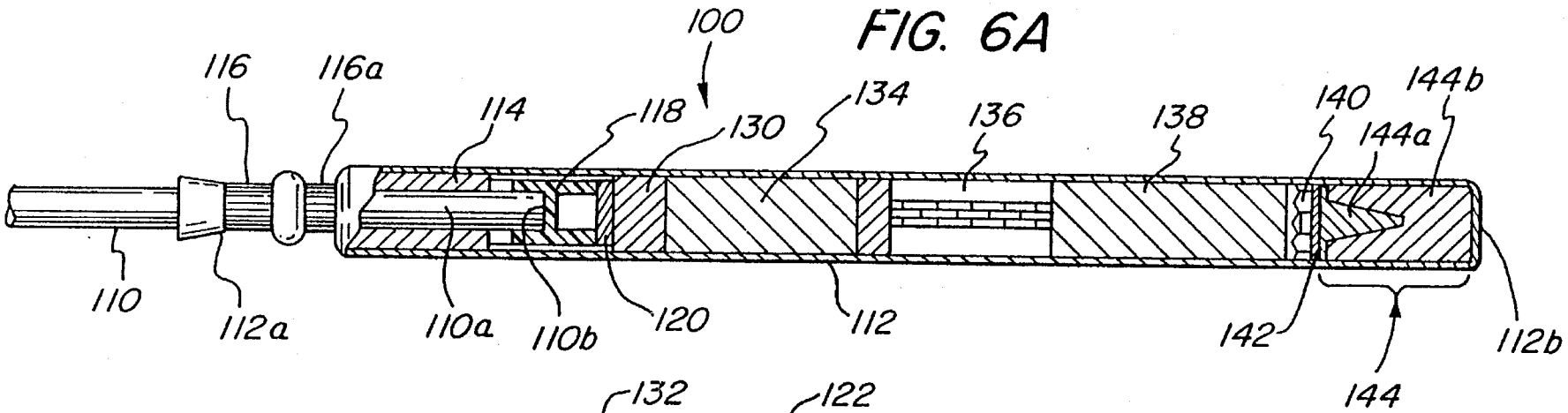
FIG. 6A is a schematic view partly in cross section showing one embodiment of a delay detonator comprising a timer circuit according to one embodiment of the present invention, and having a shock tube input transmission line coupled thereto.

Referring now to FIG. 6A, there is shown one embodiment of an electronic digital delay detonator 100 comprising a timer circuit according to the present invention. In the illustrated embodiment, the delay detonator is coupled to a suitable input transmission line which comprises, in the illustrated case, a shock tube 110. It is to be understood, however, that other nonelectric signal transmission means such as a detonating cord, low energy detonating cord, low velocity shock tube and the like may be used. Generally, any suitable nonelectric, impulse signal transmission means may be employed. As is well-known to those skilled in the art, shock tube comprises hollow plastic tubing, the inside wall of which is coated with an explosive material so that upon ignition, a low energy shock wave is propagated through the tube. Shock tube 110 is fitted to a suitable housing 112 by means of an adapter bushing 114 about which housing 112 is crimped at crimps 116, 116*a* to secure shock tube 110 and form an environmentally protective seal between adapter bushing 114 and the outer surface of shock tube 110. Housing 112 has an open end 112*a* which receives bushing 114 and shock tube 110, and an opposite, closed end 112*b*. Housing 112 is made of an electrically conductive material, usually aluminum, and is preferably the size and shape of conventional blasting caps, i.e., detonators. A segment 110*a* of shock tube 110 extends within housing 112 and terminates at end 110*b* in close proximity to, or in abutting contact with, an anti-static isolation cup 118.

Figure 6B:
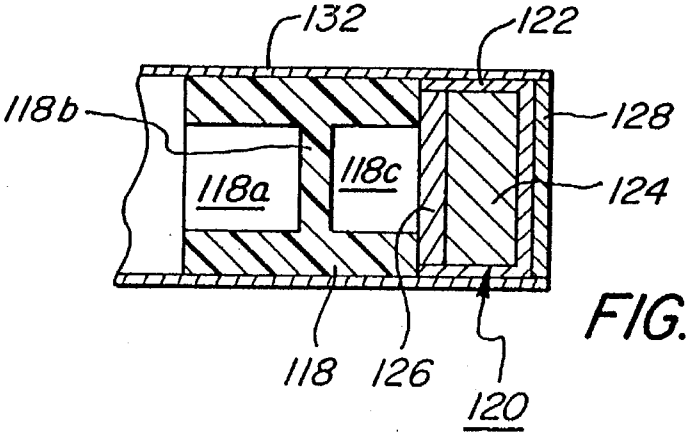
FIG. 6B is a view, on a scale which is enlarged relative to FIG. 6A, of the isolation cup and booster charge components of the detonator of FIG. 6A.

Isolation cup 118, as best seen in FIG. 6B, is of a type well-known in the art and is made of a semiconductive material, e.g., a carbon-filled polymeric material, so that it forms a path to ground, to dissipate any static electricity which may travel along the interior of shock tube 110. A low energy booster charge 120 is positioned adjacent to anti-static isolation cup 118. As best seen in FIG. 6B, anti-static isolation cup 118 comprises, as is well-known in the art, a generally cylindrical body (which is usually in the form of a truncated cone, with the larger diameter positioned closer to the open end 112*a* of housing 112) which is divided by a thin, rupturable membrane 118*b* into an entry chamber 118*a* and an exit chamber 118*c*. The end 110*b* of shock tube 110 (FIG. 6A) is received within entry chamber 118*a* (shock tube 110 is not shown in FIG. 6B for clarity of illustration). Exit chamber 118*c* provides an air space or stand-off between the end 110*b* of shock tube 110 and booster charge 120. In operation, the shock wave traveling through shock tube 110 will rupture membrane 118*b* and traverse the stand-off provided by exit chamber 118*c* and impinge upon and detonate booster charge 120.

Booster charge 120 itself comprises a booster charge shell 122 of cup-like configuration within which is pressed a small quantity of primary explosive 124, such as lead azide, which is closed by a first cushion element 126. First cushion element 126, which is located between isolation cup 118 and primary explosive 124, protects primary explosive 124 from pressure imposed upon it during manufacture.

A non-conductive buffer 128, which is typically 0.030 inches thick, is located between booster charge 120 and a piezoelectric generator 130 to electrically isolate piezoelectric generator 130 from booster charge 120.

Adapter bushing 114, isolation cup 118, first cushion element 126, and booster charge 120 may conveniently be fitted into a booster shell 132 as shown in FIG. 6B. The outer surface of isolation cup 118 is in conductive contact with the inner surface of booster shell 132 which in turn is in conductive contact with housing 112 to provide an electrical current path for any static electricity discharged from shock tube 110. Generally, booster shell 132 is inserted into housing 112 and housing 112 is crimped to retain booster shell 132 therein as well as to protect the contents of housing 112 from the environment.

Referring again to FIG. 6A, a capacitor 134 is connected to piezoelectric generator 130 to receive electrical output from generator 130 for storage. Capacitor 134 may be a 10 micro-farad unit rated at 35 volts. Its series resistance is preferably low to accommodate the fast rise time of the 1 to 2 microsecond-long pulses it will receive from piezoelectric generator 130.

A battery means 136 is positioned next to capacitor 134 and adjacent to battery means 136 is a timing module 138 next to which is located an electrically activated igniter means 140. A second cushion element 142, which is similar to first cushion element 126, is interposed between output charge 144 and an electrically activated igniter means 140 for the same purpose as first cushion element 126. Output charge 144 comprises a primary explosive 144*a* and a secondary explosive 144*b*, which has sufficient shock power to detonate cast booster explosives, dynamite, etc., the detonation of which is the usual purpose to which detonators are put. Igniter means 140, which is connected to the output of timing module 138, when energized detonates primary explosive 144*a*, which in turn detonates secondary explosive 144*b*, i.e., igniter means 140 serves to detonate output charge 144. Igniter means 140 is positioned within a preferably non-conductive bushing (not shown) which serves to prevent inadvertent detonation of output charge 144 by igniter means 140 by virtue of the relatively low resistivity of the bushing and its contact with housing 112.

The components contained within housing 112 are suitably encased within potting compounds to protect the components and to minimize the chances of detonation or damage by mechanical impact or electrical signals. The fact that housing 112 is made of aluminum or other electrically conductive material also helps to shield the internal components against both electrical signals and mechanical shocks that could inadvertently activate booster charge 120 or output charge 144. The electrically conductive housing 112 provides a high degree of attenuation of potentially damaging electrical fields by forming a Faraday cage around the electrically sensitive components. The size and configuration of the housing 112 is, as noted above, preferably selected to duplicate industry standard detonator sizes currently in use.

In operation, the digital delay detonator 100 of FIG. 6A receives a pressure input pulse via shock tube 110 which detonates booster charge 120, the explosive output of which is thus an amplification of the pressure input pulse delivered by shock tube 110. Piezoelectric generator 130 is subjected to the energy delivered by the explosion of booster charge 120 and converts the energy into electrical energy. This electrical energy is stored in storage capacitor 134 and a part of it is used to activate the timing circuit of timing module 138 and, after lapse of a preselected interval, to energize igniter means 140 to detonate output charge 144. Battery means 136 is used to supply the necessary power to operate the delay timing circuitry of timing module 138. Upon completion of its timing cycle, the stored energy from capacitor 134 is applied to electrically activated igniter means 140, thereby detonating primary explosive 144*a* and secondary explosive 144*b*. The delay detonator 100 may thus be employed to provide a very accurately controlled delay in the initiation of an explosive charge as may be required in blasting patterns in which a large number of charges are to be detonated in a predetermined timing pattern. The electronic circuit control of the delay permits much more accurate delays than those which are attainable by conventional pyrotechnic delays, and the battery-powered timing means permits the selection of much longer delays than would be attainable if the piezoelectric generator 130 had to supply the power for both powering the timing circuits and energizing the igniter means 140.

In an alternative embodiment, shock tube 110 of the FIG. 6A embodiment may be replaced by a transmission line comprising a low energy detonating cord. The energy output of the detonating cord is selected to be low enough so as not to destroy the components of the delay detonator to prevent it from functioning, but high enough to cause the input impulse signal provided by the explosive output of low energy detonating cord to act, without need for amplification, directly on the piezoelectric generator. Consequently, booster charge 120 of the FIG. 6A embodiment may be omitted from a detonating cord embodiment, as may isolation cup 118, for which there would be no need. Otherwise, the other parts of a detonating cord embodiment, their arrangement and operation, are the same as those discussed in conjunction with the embodiment of FIG. 6A and it is therefore not necessary to repeat the illustration and description thereof.

Figure 7:
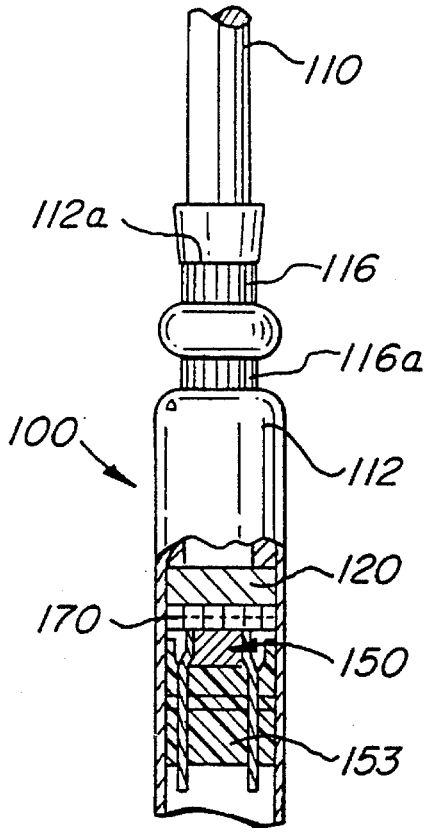
FIG. 7 is a schematic partial view generally corresponding to that of FIG. 6A but showing a schematic structural rendition of piezoelectric generator 130 instead of the schematic box rendition of FIG. 6A.
Figure 8:
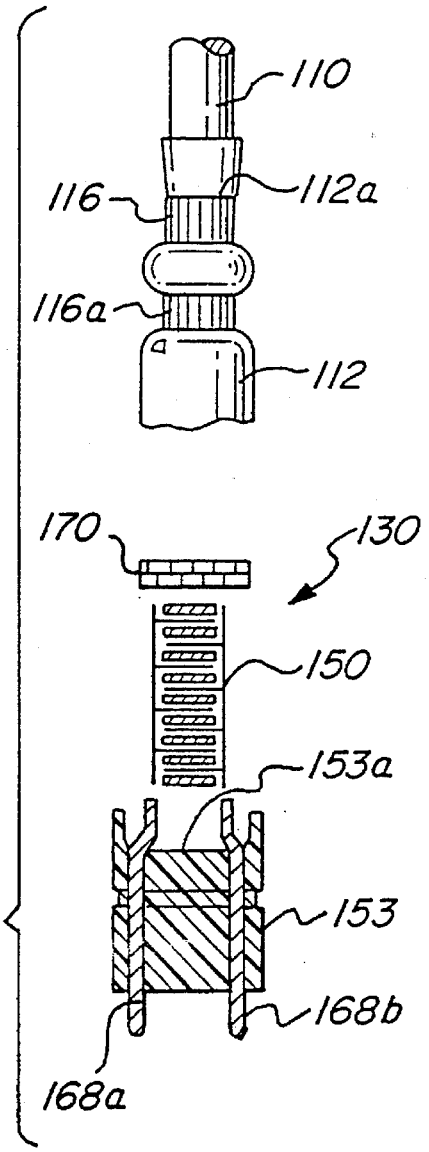
FIG. 8 is a schematic exploded view of the components of FIG. 7 on a scale enlarged relative to FIG. 7, with the piezoelectric generator component thereof shown in a a more detailed, schematic rendition.
Figure 9:
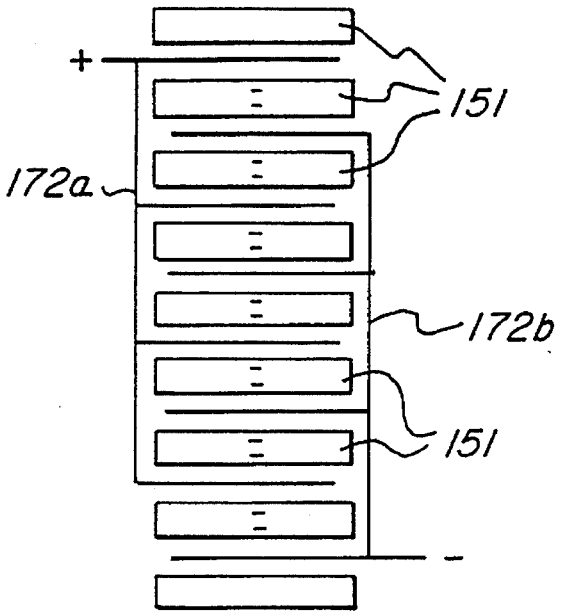
FIG. 9 is a view on a scale enlarged with respect to FIG. 8 of a more detailed schematic view of the piezoelectric generator of FIGS. 7 and 8.
Figure 1:
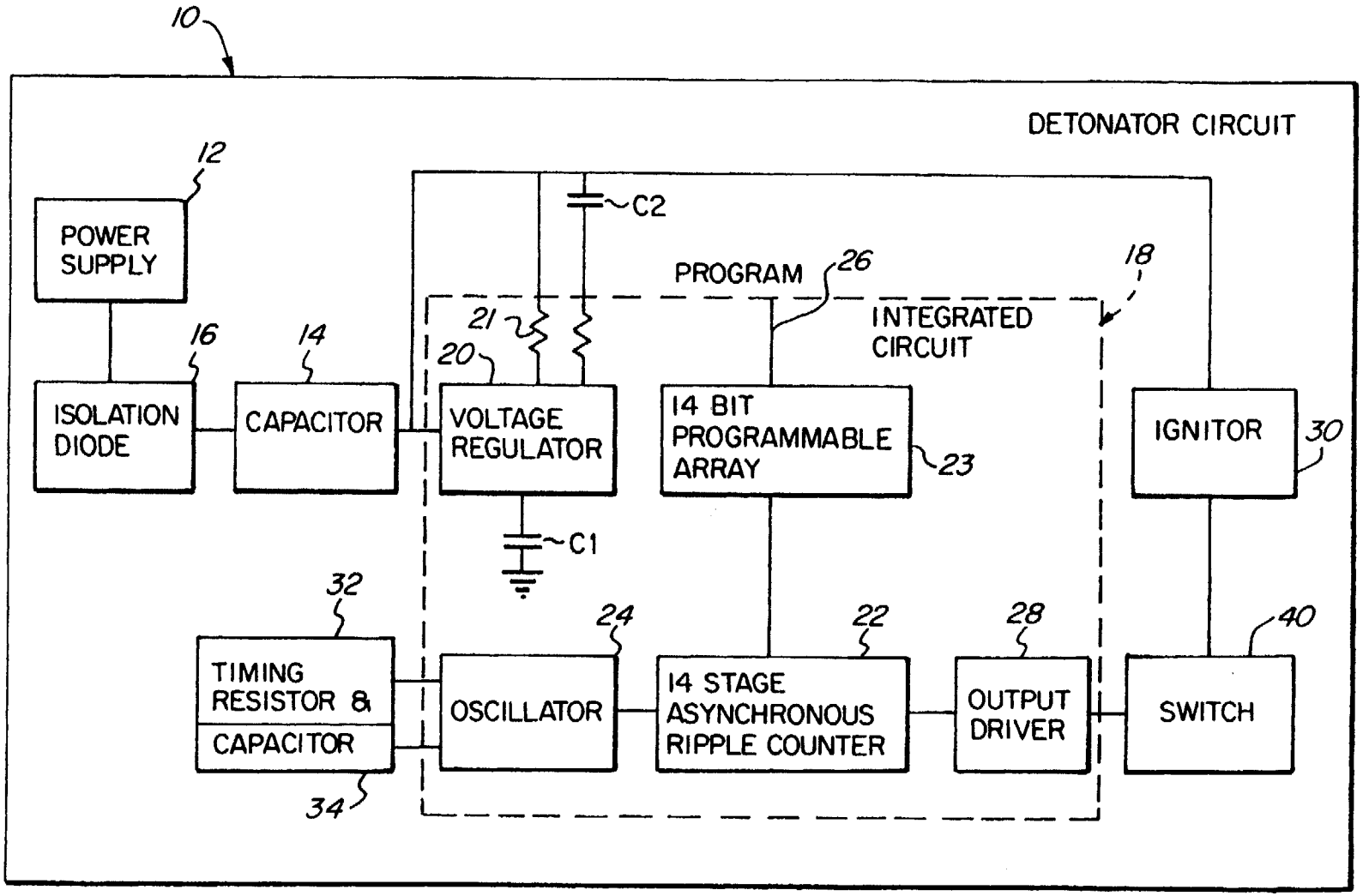
Figure 4:
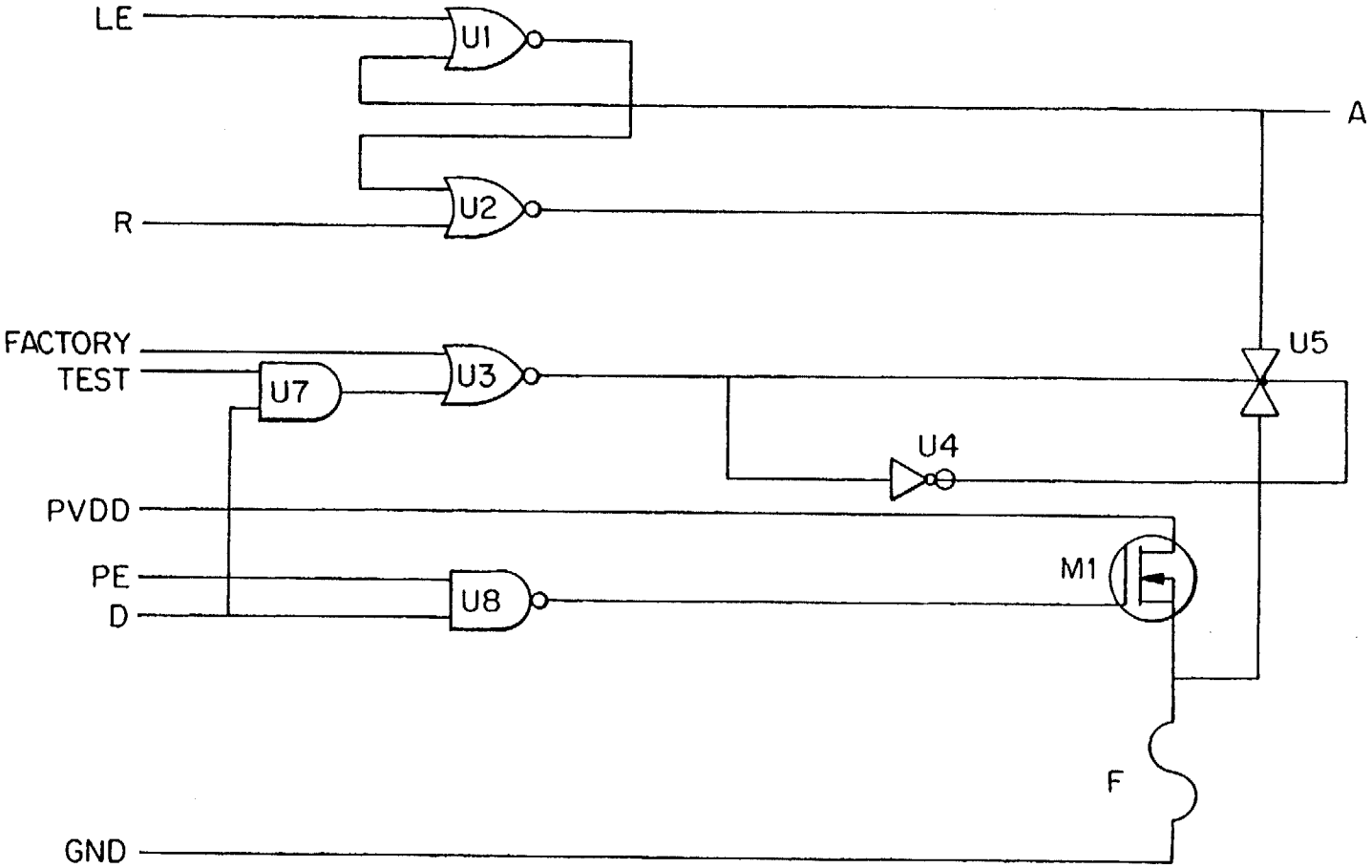
Figure 5:
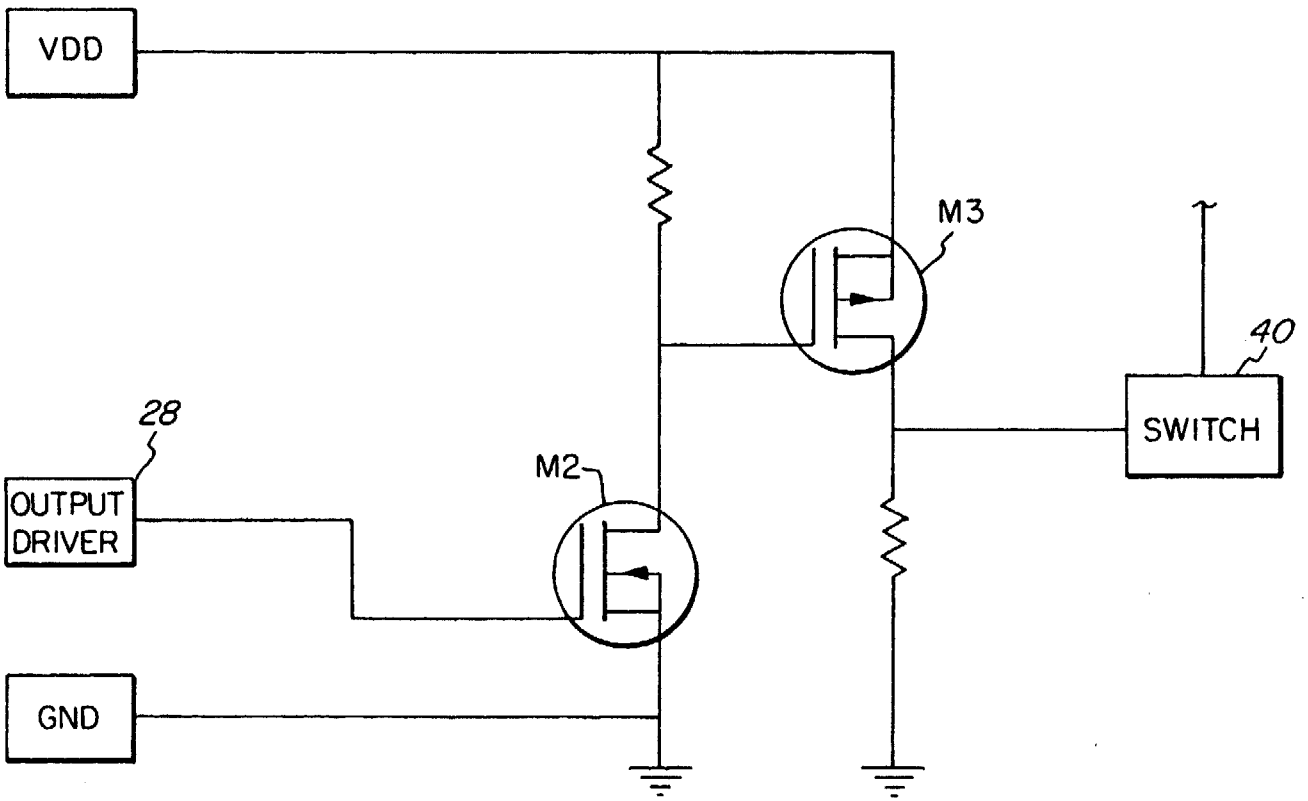
Figure 5:
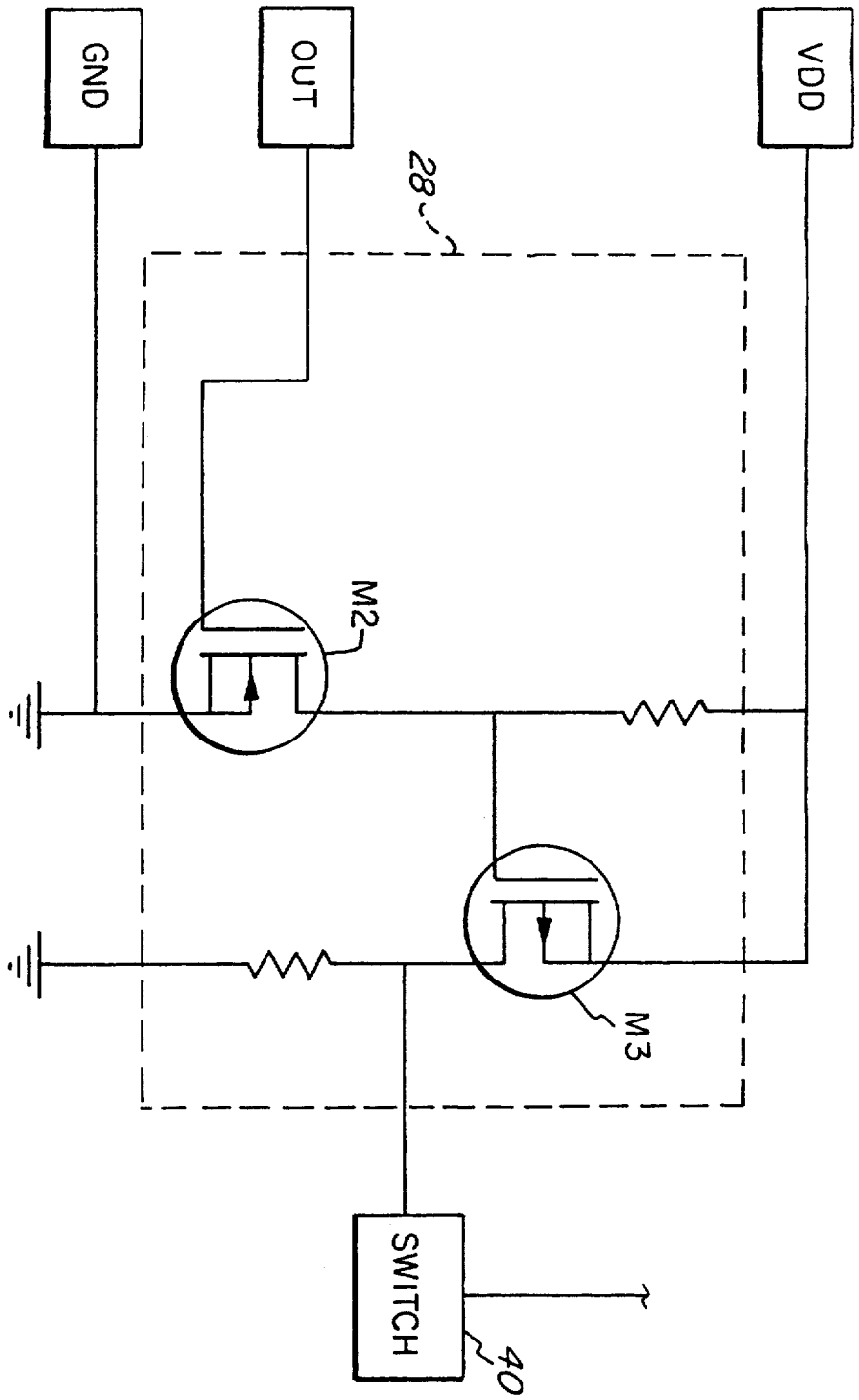

While any suitable transducer may be employed as a power supply in the practice of the present invention to provide an electrical pulse in response to an impulse signal, an effective type of piezoelectric generator is schematically illustrated in FIGS. 7, 8 and 9, in which elements which are also shown in FIGS. 6A and 6B are numbered identically in both sets of Figures.

The piezoelectric generator 130 comprises a piezoceramic material stack 150 comprised of a stack of multiple layers 151 of thin piezoceramic material. The stack 150 is supported on a suitable plastic (synthetic organic polymeric material) housing 153, through which terminals 168A and 168*b* (FIG. 8) extend. The output energy from the booster charge 120 impinges substantially directly upon a load distributing disc 170 (not shown in FIGS. 6A or 6B), which in turn evenly transmits the energy from the booster charge 120 to the multiple layers 151 of suitable thin piezoceramic material which comprise one embodiment of the stack 150 of piezoelectric generator 130. As best seen in the schematic representation of FIG. 9, the piezoceramic material layers 151 are stacked in vertical layers with opposite faces of each layer connected in parallel through the use of electrode layers 172*a* and 172*b* interposed between each layer or element 151. In one embodiment, the piezoelectric generator of the present invention uses 184 active layers, each approximately 20 microns thick, with discrete positive and negative electrodes as marked on FIG. 9 formed from the inner connections. This construction provides output energy levels much greater than those which can be obtained from an otherwise comparable monolithic piezoceramic structure.

Referring to FIGS. 7, 8 and 9 jointly, the plastic housing 153 and load distributing disc 170 contribute, in a preferred structure of the present invention, to obtaining the maximum benefit from the output shock wave of the booster charge 120 and the physical pressure attendant thereto. The stack 150 of piezoelectric generator 130 is mounted to a smooth, flat and hard surface 153*a* of plastic housing 153 (FIG. 8). Surface 153*a* is substantially parallel to the shock wave front generated by detonation of booster charge 120 and perpendicular to the direction of shock wave travel. To further obtain maxium benefit from the output shock wave of the booster charge 120, the load distributing disc 170 is disposed substantially parallel to and between the output end of the booster charge 120 and the input face of the piezoelectric generator 130 to evenly transmit and distribute the output shock wave energy of the booster charge 120 to the piezoelectric generator 130. This arrangement also helps to prevent premature shattering of the piezoelectric generator 130 which would render it inoperable. Terminals 168*a* and 168*b* are electrically connected to electrode layers 172*a* and 172*b* to establish the desired electrical connection to the timing module 138 (FIG. 6A). Plastic housing 153 and load distributing disc 170 also serve to insulate piezoelectric generator 130 against unintended and random mechanical forces, any electrical charges, etc., and serves to help maintain the piezoelectric generator in the desired position.

While the invention has been described in detail with reference to a particular embodiment thereof, it will be apparent that upon a reading and understanding of the foregoing, numerous alterations to the described embodiment will occur to those skilled in the art and it is intended to include such alterations within the scope of the appended claims.

What is claimed is:

1. A programmable timer circuit which is designed to receive an electric initiation signal and to produce a timer output signal at a predetermined time interval from receipt of the electric initiation signal, the timer circuit comprising:

(a) an electrically powered counter comprising a plurality of sequential counter stages including a first counter stage and a last counter stage for issuing a timer output signal, each counter stage being configured to receive a counter stage input signal having one of an active and an inactive logic state and to issue a counter stage output signal having one of an active and an inactive logic state, the logic state of a counter stage output signal being responsive to a change in the logic state of the counter stage input signal;

(b) an electrically powered oscillator for providing a counter stage input signal to the first counter stage;

(c) an electrically powered programming circuit comprising (i) a toggle logic gate between each counter stage and the next sequential counter stage for receiving from the preceding counter stage the counter stage output signal and for receiving a program stage signal having one of an active and an inactive logic state, the toggle logic gate issuing to the succeeding counter stage a counter stage input signal having a logic state determined by the logic states of the program stage signal and the counter stage output signal, and (ii) a program stage associated with each toggle logic gate, each program stage being configured to issue to the associated toggle logic gate the program stage signal;

(d) electronic initializing means for placing the timer circuit in a logic state determined by the programming circuit prior to incrementing the counter; and (e) power supply means for providing operating power to at least the counter, the oscillator, the programming circuit and the initializing means.

2. The timer circuit of claim 1 wherein the programming circuit comprises a fuse current input and wherein each program stage comprises:

(a) a latch means for producing a latch signal from which the program stage signal is derived;

(b) a fuse which when intact during operation of the timer grounds the latch signal whereby the program stage signal has an inactive logic state and which when blown allows the latch signal to yield a program stage signal having an active logic state; and (c) a fuse switch means responsive to the logic state of the preceding counter stage output signal, for passing the fuse current to the fuse to blow the fuse when the preceding counter stage output is active.

3. The timer circuit of claim 2 further comprising a program signal input for receiving and conveying to each program stage a program signal and wherein each fuse switch means is responsive to the presence of a program signal whereby the fuse switch means will pass the fuse current to the fuse when the preceding stage output signal has an active logic state.

4. The timer circuit of claim 2 or claim 3 wherein the programming circuit further comprises test means associated with each program stage for yielding an active program stage signal even when the fuse is intact.

5. An electronic delay detonator circuit for use in blasting initiation systems energized by a non-electric impulse signal comprises: (i) a signal conversion means for receiving an impulse signal from an impulse signal transmission line and converting the impulse signal to an electric initiation signal; and (ii) an electronic timer circuit for counting a selected time interval in response to receiving the electric initiation signal, the timer circuit comprising:

(a) an electrically powered counter comprising a plurality of sequential counter stages including a first counter stage and a last counter stage for issuing a timer output signal, each counter stage being configured to receive a counter stage input signal having one of an active and an inactive logic state and to issue a counter stage output signal having one of an active and an inactive logic state, the logic state of a counter stage output signal being responsive to a change in the logic state of the counter stage input signal;

(b) an electrically powered oscillator for providing a counter stage input signal to the first counter stage;

(c) an electrically powered programming circuit comprising (i) a toggle logic gate between each counter stage and the next sequential counter stage for receiving from the preceding counter stage a counter stage output signal having one of an active and an inactive logic state and for receiving a program stage signal having one of an active and an inactive logic state, the toggle logic gate issuing to the succeeding counter stage a counter stage input signal having a logic state determined by the logic states of the program stage signal and the counter stage output signal, and (ii) a program stage associated with each toggle logic gate, each program stage being configured to issue to the associated toggle logic gate a program stage signal having one of an active and an inactive logic state;

(d) electronic initializing means for placing the timer circuit in a logic state determined by the programming circuit prior to incrementing the counter; and (e) electric power means for providing operating power to at least the counter, the oscillator and the programming circuit;

the electronic timer circuit being connected to the signal conversion means to receive therefrom the electric initiation signal and thereupon to start counting a selected time interval and, upon lapse of the time interval, to issue an output signal; and (iii) an electrically operable igniter means connected to the electronic timer circuit for energizing a detonator output charge upon receipt of a timer output signal from the timer circuit.

6. The detonator circuit of claim 5 wherein the programming circuit comprises a fuse current input and wherein each program stage comprises:

(a) a latch means for producing a latch signal from which the program stage signal is derived;

(b) a fuse which when intact during operation of the timer grounds the latch signal whereby the program stage signal has an inactive logic state and which when blown allows the latch signal to yield a program stage signal having an active logic state; and (c) a fuse switch means responsive to the logic state of the preceding counter stage output signal, for passing the fuse current to the fuse to blow the fuse when the preceding counter stage output is active.

7. The detonator circuit of claim 6 further comprising a program signal input for receiving and conveying to each program stage a program signal and wherein each fuse switch means is responsive to the presence of a program signal whereby the fuse switch means will pass the fuse current to the fuse when the preceding stage output signal has an active logic state.

8. The detonator circuit of claim 6 or claim 7 wherein the programming circuit further comprises test means associated with each program stage for yielding an active program stage signal even when the fuse is intact.

9. An electronic delay detonator comprising a housing having one end dimensioned and configured to be coupled to a signal transmission line capable of transmitting a non-electric impulse input signal to within the housing, an electronic delay detonator circuit as described in claim 5 with the signal conversion means disposed in signal communication relationship to the signal transmission line, and a detonator output charge in initiation relation to the igniter means.

* * * * *

UNITED STATES PATENT AND TRADEMARK OFFICE

CERTIFICATE OF CORRECTION

PATENT NO. : 5,621,184

DATED : April 15, 1997

INVENTOR(S) : James C. Gwynn, III

It is certified that error appears in the above-indentified patent and that said Letters Patent is hereby corrected as shown below:

In column 1, line 31, replace "ignition" with --initiation--.

In column 2, line 32, remove "(i)" after the word "comprising".

In column 3, line 66, remove the second instance of "a".

In column 7, line 30, replace "25'" with --25--.

In column 8, line 29, replace "Dowered" with --powered--.

In column 12, replace "168A" with --168a--.

In the drawings, Sheet 1, Figure 1, the reference numeral 23 should be applied to the circuit element labeled "14 BIT PROGRAMMABLE ARRAY".

In the drawings, Sheet 5, Figure 4, reference numeral F1 should read --F--.

Figure 5:
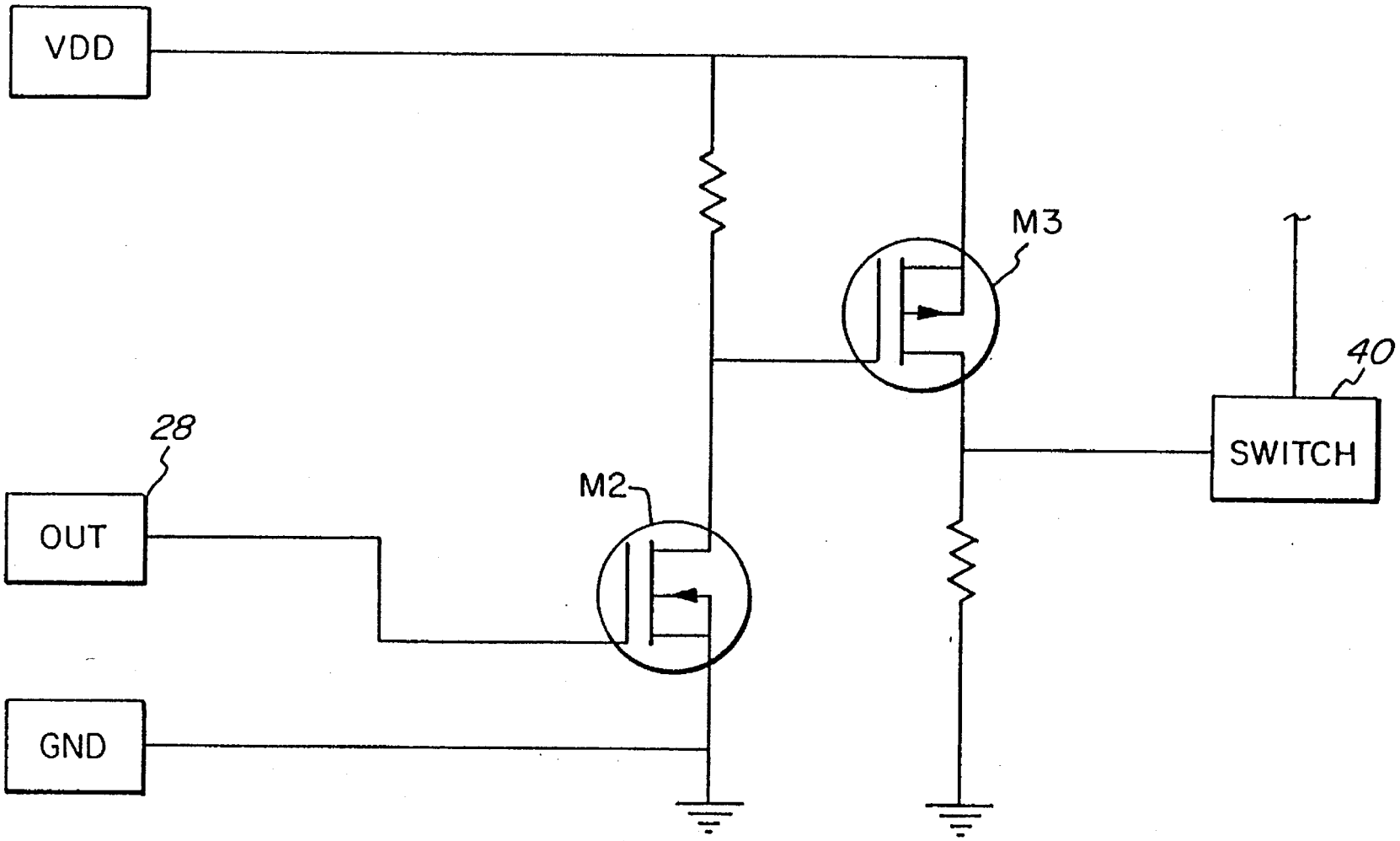
FIG. 5 is a schematic diagram of one embodiment of the output driver indicated in FIG. 1.

In the drawings, Sheet 6, Figure 5, circuit element number 28 should read --OUTPUT DRIVER--.

Signed and Sealed this

Fourteenth Day of October, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,621,184
DATED : April 15, 1997
INVENTOR(S) : James C. Gwynn, III

It is certified that error appears in the above-indentified patent and that said Letters Patent is hereby corrected as shown below:

In the drawings, Sheet 6, Figure 5, circuit element number 28 should indicate M2 and M3. as shown on the attached page.

Signed and Sealed this

Twenty-second Day of September, 1998

*Attest:*

Bruce Lehman

BRUCE LEHMAN

*Attesting Officer*

*Commissioner of Patents and Trademarks*